US009833997B2

(12) United States Patent
Takata

(10) Patent No.: US 9,833,997 B2
(45) Date of Patent: Dec. 5, 2017

(54) INKJET PRINTING MACHINE AND INK CARTRIDGE

(71) Applicant: RISO KAGAKU CORPORATION, Tokyo (JP)

(72) Inventor: Atsushi Takata, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/240,209

(22) Filed: Aug. 18, 2016

(65) Prior Publication Data

US 2017/0050440 A1 Feb. 23, 2017

(30) Foreign Application Priority Data

Aug. 20, 2015 (JP) ..... 2015-162415

(51) Int. Cl.
*B41J 2/165* (2006.01)

(52) U.S. Cl.
CPC ..... *B41J 2/16526* (2013.01); *B41J 2/1652* (2013.01); *B41J 2002/16573* (2013.01)

(58) Field of Classification Search
CPC ..... B41J 2/16517
See application file for complete search history.

(56) References Cited

U.S. PATENT DOCUMENTS 6,126,265 A 10/2000 Childers et al.
7,824,006 B2 11/2010 Park
8,465,119 B2 6/2013 Kuroda
8,690,293 B2 4/2014 Komazawa et al.
2007/0132802 A1 6/2007 Ouchi
2008/0218554 A1* 9/2008 Inoue ..... B41J 2/16526 347/33
2009/0167813 A1 7/2009 Mitchell et al.
(Continued)

FOREIGN PATENT DOCUMENTS

CN 1205272 1/1999
CN 1955003 5/2007
CN 101112818 1/2008
(Continued)

OTHER PUBLICATIONS

Chinese Office Action for CN App. No. 201610698465.8 dated Jun. 28, 2017.

*Primary Examiner* — Alessandro Amari
*Assistant Examiner* — Roger W Pisha, II
(74) *Attorney, Agent, or Firm* — Greenblum & Bernstein, P.L.C.

(57) ABSTRACT

There are provided: a maintenance unit that performs a maintenance operation simultaneously on the plurality of inkjet heads, a memory that stores, for each of ink types, a settable range of a maintenance cycle of a maintenance operation as maintenance information; and a controller that reads, from the maintenance information stored in the memory, lower limit values and upper limit values settable ranges) corresponding to table numbers stored in the memories of all the ink cartridges all the ink cartridges when a user maintenance cycle having been stored in the memory is set, and that causes the maintenance unit to perform a maintenance operation with the user-set maintenance cycle being the maintenance cycle when the user-set maintenance cycle is within the read-out settable ranges for all the ink types.

4 Claims, 8 Drawing Sheets

(56) References Cited

U.S. PATENT DOCUMENTS

2012/0026546 A1* 2/2012 Miura ..... B41J 2/175
358/1.15

FOREIGN PATENT DOCUMENTS

| | | |
|---|---|---|
| CN | 101927605 | 12/2010 |
| CN | 102161271 | 8/2011 |
| CN | 102729618 | 10/2012 |
| JP | 2002-192750 | 7/2002 |

* cited by examiner

FIG. 5

| TABLE NUMBER | DEFAULT VALUE | LOWER LIMIT VALUE | UPPER LIMIT VALUE |
|---|---|---|---|
| 1 | 500 | 100 | 700 |
| 2 | 750 | 100 | 1500 |
| 3 | 1000 | 100 | 3000 |
| 4 | 2000 | 100 | 5000 |
| 5 | 3000 | 100 | 5000 |
| 6 | 5000 | 100 | 7500 |
| 7 | 7500 | 100 | 10000 |
| 8 | 10000 | 100 | 15000 |

INKJET PRINTING MACHINE AND INK CARTRIDGE

BACKGROUND

1. Technical Field

The present invention relates to an inkjet printing machine and an ink cartridge which set a maintenance cycle in accordance with user's preference within an appropriate range.

2. Related Art

An inkjet printing machine is detachably provided with ink cartridges that hold ink for each color. The inkjet printing machine performs printing of an image, character, or the like by supplying ink from an ink cartridge to an inkjet head and discharging the ink from nozzles of the inkjet head toward a sheet.

In such an inkjet printing machine, maintenance is regularly performed in order to maintain a normal discharge state of inkjet heads. For example, there is performed purging that forcibly ejecting ink from an ink discharge surface of an inkjet head having a plurality of nozzles formed thereon, and dirt or the like sticking to the ink discharge surface is wiped off using a wiper blade, together with the ejected ink. A too long maintenance cycle may cause poor printing, whereas a too short cycle may increase wasted ink consumption. Therefore, an optimal maintenance cycle is preliminarily set on the basis of the type of ink or the characteristics of the inkjet head, or the like.

Patent Document 1 proposes technique relating to a printing machine having a memory storing ink parameter data including at least an ink parameter determined in accordance with the type of ink contained in an ink cartridge, and a controller that determines a cleaning sequence of nozzles according to the ink parameter.

Patent Document 1: Japanese Patent Application Publication No. 2002-192750

SUMMARY

Problems to be Solved by the Invention

However, there is a variety of user's preferences depending on the user such that some users want to improve the print quality as much as possible, while other users want to reduce ink consumption as much as possible.

The printing machine according to Patent Document 1 does not allow the user to flexibly set the maintenance cycle, and thus has not been flexibly successful in satisfying such user's preferences.

On the other hand, a shorter cycle than the lower limit of a maintenance cycle corresponding to a necessary and sufficient maintenance frequency may be set by the user when allowing the user to freely set the maintenance cycle. In such a case, an originally unnecessary maintenance operation may be performed, thereby resulting in wasted ink consumption.

Furthermore, a longer cycle than the upper limit of a maintenance cycle corresponding to the necessary and sufficient maintenance frequency may be set by the user when allowing the user to freely set the maintenance cycle. Namely, the dirt sticking to the ink discharge surface may be caused to accumulate on the inkjet head by the user setting a very long maintenance cycle so that maintenance operation is hardly performed, which may lead to exchange of inkjet heads due to nozzle clogging or the like.

Therefore, there has been caused a possibility of becoming a burden on the user when allowing the user to freely set a maintenance cycle.

The present invention has been made in view of the above problem. An object of the present invention is to provide an inkjet printing machine that sets a maintenance cycle in accordance with user's preferences within an appropriate range.

Means to Solve the Problems

In order to achieve the aforementioned object, a first characteristic of the inkjet printing machine according to the present invention is an inkjet printing machine having a main device that performs printing by discharging ink from a plurality of inkjet heads, and ink cartridges being detachably mounted on the main device and having memories that store ink types of ink held therein, the printing machine including: a maintenance section configured to perform a maintenance operation simultaneously on the plurality of inkjet heads; a storage section configured to store, for each of the ink types, a settable range of a maintenance cycle to be performed by the maintenance section, as maintenance information; a user setting section configured to perform user setting of the maintenance cycle on the basis of a user operation; and a controller configured to read, from the maintenance information, settable ranges of the maintenance cycles corresponding to ink types stored in the memories of all the ink cartridges when user setting of the maintenance cycle has been performed by the user setting section, and to set the user-set maintenance cycle as the maintenance cycle of the maintenance section when the user-set maintenance cycle is within the read-out settable ranges for all the ink types.

A second characteristic of the inkjet printing machine according to the present invention lies in the fact that the storage section stores, for each of the ink types, a settable range of the maintenance cycle and a default value of the maintenance cycle in association with each other, as maintenance information, and the controller reads, from the maintenance information, settable ranges and default values of the maintenance cycles corresponding to ink types stored in the memories of all the ink cartridges when user setting of the maintenance cycle has been performed by the user setting section, and sets the shortest default value among the read-out default values as the maintenance cycle of the maintenance section when the user-set maintenance cycle is outside the read-out settable range of any of the ink types.

A third characteristic of the inkjet printing machine according to the present invention lies in the fact that the storage section stores, for each of the ink types, a settable range of the maintenance cycle and a default value of the maintenance cycle in association with each other, as maintenance information, and the controller reads, from the maintenance information, settable ranges and default values of the maintenance cycles corresponding to ink types stored in the memories of all the ink cartridges s when user setting of the maintenance cycle has been performed by the user setting section, and sets, as the maintenance cycle of the maintenance section, the upper limit value or the lower limit value falling in a settable range to all the ink types, which is closer to the user-set maintenance cycle when the user-set maintenance cycle is outside the read-out settable range of any of the ink types.

A first characteristic of the ink cartridge according to the present invention lies in the fact that the ink cartridge has memories that store the ink types of ink discharged from the plurality of inkjet heads, the memories enables the main device to perform the maintenance operation on the basis of the user-set maintenance cycle when the user setting of the maintenance cycle has been performed and the user-set maintenance cycle is within the read-out settable ranges for all the ink types.

BRIEF DESCRIPTION OF DRAWINGS

The invention will now be described with reference to the accompanying drawings wherein:

FIG. 5 is a diagram illustrating exemplary maintenance information stored in the memory included by the inkjet printing machine according to Example 1 of the present invention;

DETAILED DESCRIPTION

An inkjet printing machine according to Example 1 of the present invention will be described below with reference to the drawings.

Example 1 of Present Invention

Figure 1:
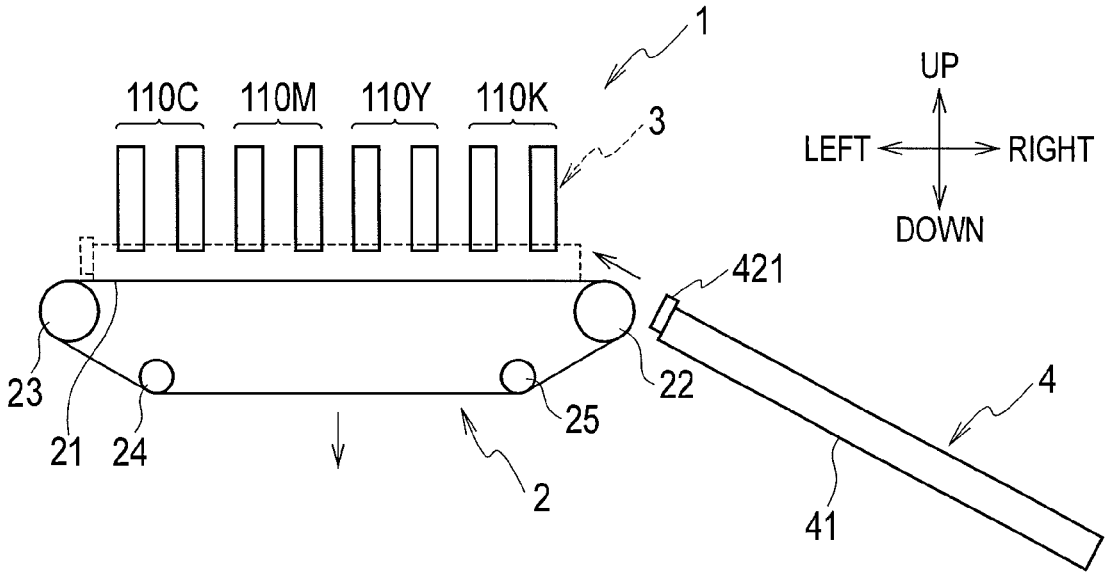
FIG. 1 is a schematic configuration diagram of an inkjet printing machine according to Example 1 of the present invention.

FIG. 1 is a schematic configuration diagram of an inkjet printing machine according to Example 1 of the present invention. As illustrated in FIG. 1, an inkjet printing machine 1 according to Example 1 of the present invention includes a transfer section 2, a head unit 3, and a maintenance unit 4.

In the following description, the front side of the plane (near side) of FIG. 1 is assumed to be the front side of the inkjet printing machine. Furthermore, as illustrated in FIG. 1, it is assumed that the head unit 3 is positioned above the transfer section 2, with the direction in which the head unit 3 is positioned relative to the transfer section 2 is being the upward direction. It is assumed that the direction opposite to the upward direction is the downward direction, and the rightward and leftward directions are defined on the basis of the upward and downward directions defined in the aforementioned manner. It is assumed that the terms "lower side", "left side", and "right side" are defined in a similar manner.

The transfer section 2 includes a transfer belt 21 provided facing the head unit 3, a drive roller 22 which circularly drives the transfer belt 21, and driven rollers 23, 24 and 25 driven by the drive roller 22.

The transfer belt 21 is stretched over the drive roller 22 and driven rollers 23, 24 and 25, moves endlessly by the drive of the drive roller 22 at the time of printing, and holds and transfers sheets supplied from the paper feed tray (not illustrated) provided on the left side.

The transfer section 2 is movably constituted by a vertical movement motor 44 described below or the like, across a printing position at which a transfer process of a sheet is performed at the time of printing, an evacuation position which is lowered on a lower side than the printing position and on which the maintenance unit 4 is moved, and a maintenance position which is raised to a higher position than the evacuation position together with the maintenance unit 4 and at which the maintenance unit 4 is caused to execute maintenance of the head unit 3. The movement of the transfer section 2 to the evacuation position is performed in order to move the maintenance unit 4 between the transfer section 2 and the head unit 3 when performing maintenance of the head unit 3.

The head unit 3 has line-type inkjet heads 110C, 110M, 110Y and 110K as will be described below, and discharges ink to thereby print an image on a sheet transferred from the left to the right direction by the transfer belt 21, on the basis of a print job. The inkjet heads 110C, 110M, 110Y and 110K are arranged on the upper part of the transfer section 2 horizontally at a regular interval.

In addition, as will be described below, the inkjet heads 110C, 110M, 110M, 110Y and 110K are subjected to a maintenance operation in a maintenance cycle which has been set in order to maintain a normal discharge state.

When a maintenance operation is performed, the maintenance unit 4 is moved to a maintenance position and performs a purge operation (described below) simultaneously on inkjet heads corresponding to C (cyan), M (magenta), Y (yellow) and K (black) ink at the maintenance position, to thereby eject the ink from the nozzles and wipe off dirt or the like sticking to the ink discharge surface by using a wiper blade (not illustrated) together with the ejected ink.

<Configuration of Inkjet Printing Machine>

Figure 2:
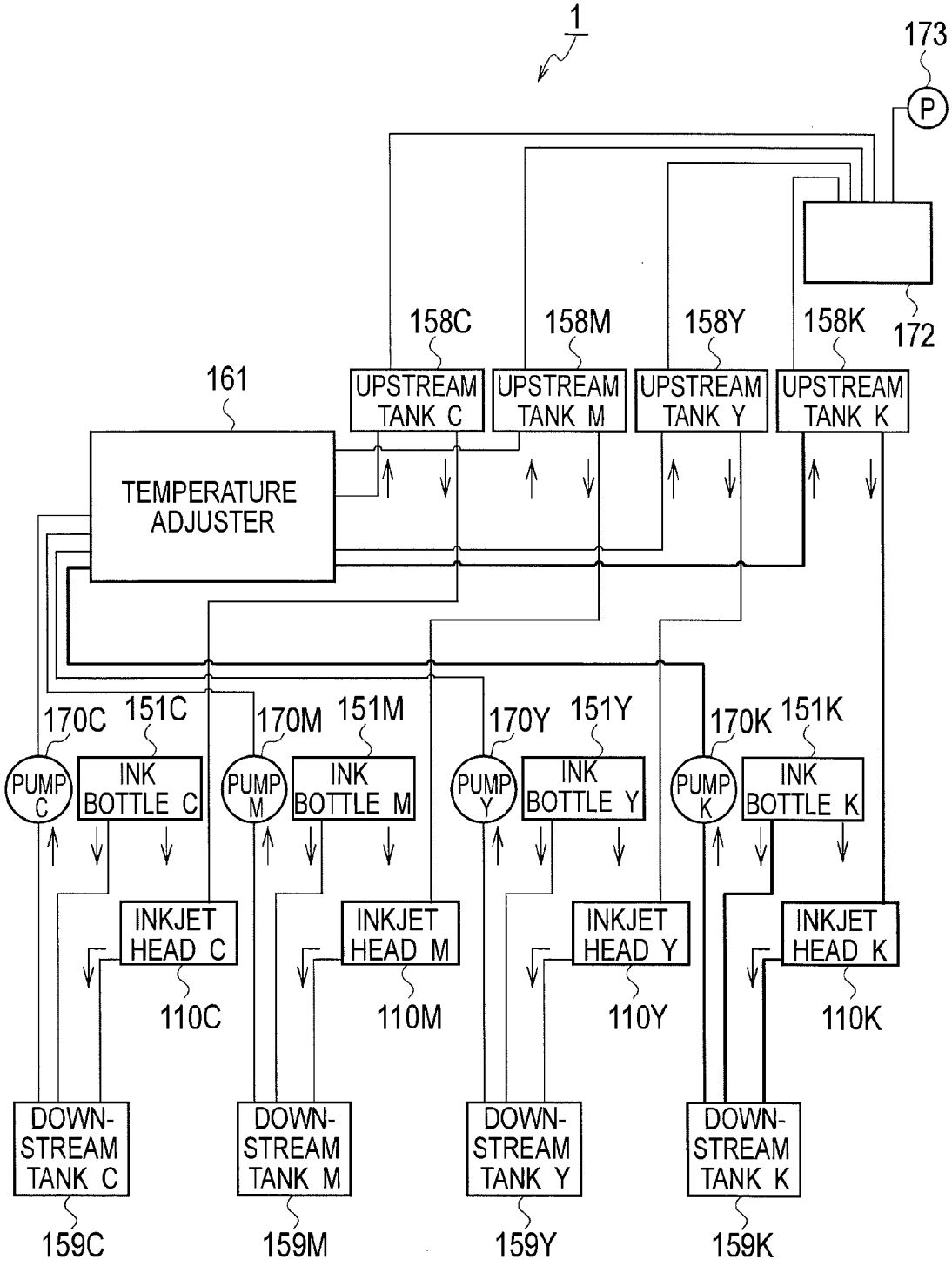
FIG. 2 is a diagram explaining the configuration of the inkjet printing machine according to Example 1 of the present invention.

FIG. 2 is a diagram explaining the configuration of the inkjet printing machine according to Example 1 of the present invention.

As illustrated in FIG. 2, the inkjet printing machine 1 includes inkjet heads 110C, 110M, 110Y and 110K corresponding to C (cyan), M (magenta), Y (yellow) and K (black) ink. After a sheet has been transferred by the transfer roller in the machine, the sheet is printed line-by-line with the ink discharged from the inkjet heads 110C, 110M, 110Y and 110K while being transferred by an annular transfer belt (not illustrated) provided on a surface facing the inkjet heads 110C, 110M, 110Y and 110K, at a speed determined in a print condition.

Each ink is supposed to be supplied from a detachable ink bottle, and there are provided an ink bottle 151C that supplies C (cyan) ink, an ink bottle 151M that supplies M (magenta) ink, and ink bottle 151Y configured to supply Y (yellow) ink, and an ink bottle 151K that supplies K (black) ink. Note that, in the following, description will be provided for the ink bottle 151 as a representative when a particular ink color is not of interest. The same also applies to other functional units.

The ink supplied from the ink bottle 151 passes through an ink circulation path formed by a pipe made of resin, metal or the like, and is collected in a downstream tank provided on the downstream side of the inkjet heads 110. Accordingly, the inkjet printing machine 1 is provided with a downstream tank 159C that collects C (cyan) ink, a downstream tank 159M that collects M (magenta) ink, a downstream tank 159Y that collects Y (yellow) ink, and a downstream tank 159K that collects K (black) ink.

The ink collected in the downstream tank 159 is delivered by a pump to an upstream tank provided on the upstream side of the inkjet heads 110. Accordingly, the inkjet printing machine 1 is provided with pumps 170C, 170M, 170Y and 170K, as well as upstream tanks 158C, 158M, 158Y and 158K. The ink delivered to the upstream tank 158 is sent to the inkjet heads 110 having many nozzles for discharging ink provided thereon.

The ink which has not been discharged from the inkjet heads 110 is returned to the downstream tank 159. The water head difference between the upstream tank 158 and the downstream tank 159 is used for return of the ink from the upstream tank 158 to the downstream tank 159 via the inkjet heads 110.

A common air chamber 172 is connected to the upstream tank 158, and a pump 173 provided in the common air chamber 172 sends air into the upstream tank 158.

The ink has a temperature range defined thereof in which the print quality is ensured, and it is necessary to heat the ink when the environmental temperature is low and ink temperature falls below the lower-limit temperature allowing printing. On the other hand, a driver or a piezoelectric element provided in the inkjet heads 110 is heated by operation, and it is necessary to suppress the influence or the like of ink temperature increase due to such heating or Joule heat of ink vibration when the temperature is high. Therefore, a temperature adjuster 161 is provided on the ink circulation path, and heats or cools the ink.

Next, an ink circulation path through which ink discharged from nozzles of an inkjet head is circulated and a purge operation using the ink circulation path will described in detail.

Figure 3:
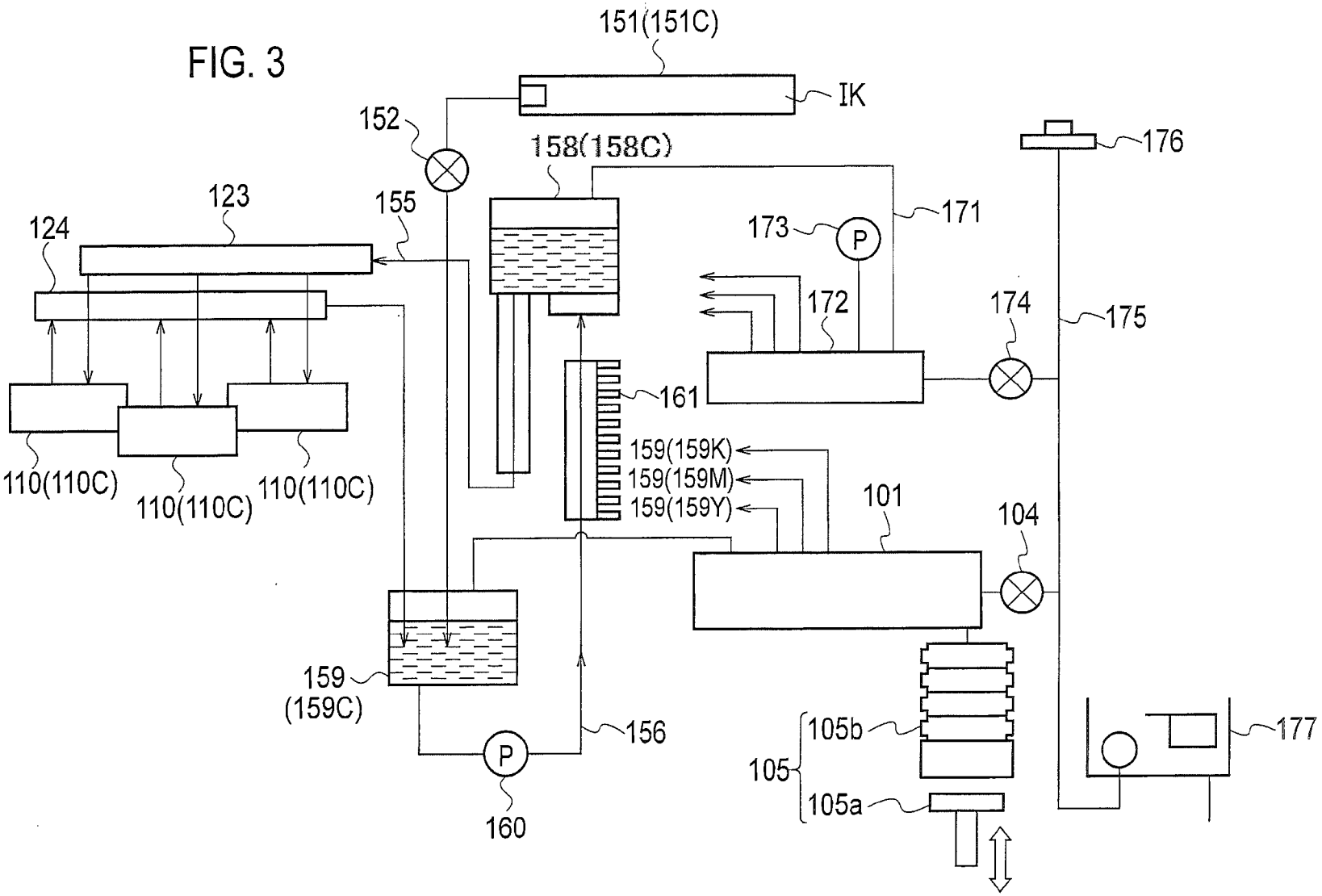
FIG. 3 is a diagram schematically illustrating an ink circulation path through which ink discharged from nozzles of an inkjet head is circulated in the inkjet printing machine according to Example 1 of the present invention.

FIG. 3 is a diagram schematically illustrating an ink circulation path through which ink discharged from nozzles of an inkjet head is circulated in the inkjet printing machine according to Example 1 of the present invention. Note that, although an ink circulation path of C (cyan) ink will be described as a representative here, ink circulation paths for M (magenta), Y (yellow) and K (black) also have a similar configuration.

As illustrated in FIG. 3, the inkjet printing machine 1 according to Example 1 of the present invention has the upstream tank 158 that stores ink IK, as described above. In addition, the upstream tank 158 and an ink supply chamber 123 provided on the upstream side the inkjet heads 110 that discharge ink are connected via an ink supply path 155.

Furthermore, an ink collection chamber 124 provided on the downstream side of the inkjet heads 110, the downstream tank 159 that stores ink IK collected from the ink collection chamber 124, a pump 160, the temperature adjuster 161, and the upstream tank 158 are connected via an ink collection path 156. Accordingly, the ink held in the downstream tank 159 is delivered to the temperature adjuster 161 side by activating the pump 160.

The upstream tank 158 has an air communication path 171 connected thereto, and the common air chamber 172 connected to an air layer above the upstream tank 158 is provided via the air communication path 171.

The common air chamber 172 has an air release pipe 175 connected thereto, is provided with the air release pipe 175, and the inside of the common air chamber 172 is opened into the atmosphere by opening the air release valve 174. In addition, the common air chamber 172 can also be sealed by closing the air release valve 174. Furthermore, the common air chamber 172 is provided with the pump 173 that sends air into the common air chamber 172.

As thus described, the common air chamber 172 is provided with the air release valve 174 and the pump 173, and thus air pressure in the common air chamber 172 can be adjusted, and pressure of the air layer above the upstream tank 158 being in communication with the common air chamber 172 can be adjusted.

In addition, the air release pipe 175 is provided with air filter 176 that prevents dirt in the air from entering the air release pipe 175, and an overflow pan 177 that collects ink which has overflown from the downstream tank 159 and flowed into the air release pipe 175, at the lower part thereof.

The downstream tank 159 is connected to the ink bottle 151 filled with ink and fresh ink IK held in the ink bottle 151 is supplied to the downstream tank 159 by opening an ink supply valve 152.

Note that, when the downstream tank 159 is kept at the atmospheric pressure, the height position of the downstream tank 159 is determined so that an appropriate pressure that generates a meniscus in the nozzles is reached by the water head difference between the downstream tank 159 and the nozzles of the inkjet heads 110.

Therefore, in the case of circulating ink IK through an ink circulation path 157 formed by the ink supply path 155 and the ink collection path 156, when opening the air release valve 174 provided in the common air chamber 172, ink IK stored in the upstream tank 158 is supplied to the ink supply chamber 123 of the inkjet head unit through the ink supply path 155 due to the water head difference between the upstream tank 158 and the downstream tank 159. Then, the Ink 1K is distributed from the ink supply chamber 123 to a plurality of inkjet heads 110 arranged two-dimensionally, and ink IK is selectively discharged on the sheet from each of the inkjet heads 110.

In addition, there is provided a downstream common air chamber 101 being in communication with the air layer of the downstream tank 159, and a pressure regulator 105 is connected to the downstream common air chamber 101. A bellows main body part 105*b* expands and contracts by ascending and descending of a bellows ascending/descending mechanism 105*a* of the pressure regulator 105. Accordingly, it is possible to adjust the internal pressure of the downstream common air chamber 101.

In addition, the air release pipe 175 is connected to the downstream common air chamber 101, and is provided with an air release valve 104. The inside of the downstream common air chamber 101 is opened into the atmosphere by opening the air release valve 104, and the inside of the downstream common air chamber 101 is sealed by closing the air release valve 104.

It is possible to cause the pressure regulator 105 to perform a purge operation that raises the internal pressure of the downstream common air chamber 101, in a state where the air release valve 104 is closed. Specifically, the downstream common air chamber 101 is insulated from the atmosphere, whereby pressure of the air layer of the downstream tank 159 being in communication with the downstream common air chamber 101 rises, making it difficult for ink to flow from the ink collection chamber 124 into the downstream tank 159. Then, ink is pushed out from the nozzles of the inkjet heads 110, and ink remains on the nozzle surface of the inkjet heads 110. Subsequently, dirt or the like sticking to the ink discharge surface is wiped off with a wiper blade (not illustrated) together with the ink on the nozzle surface of the inkjet heads 110. Accordingly, it is possible to remove dirt or the like on the nozzle surface of the inkjet heads 110 and to prevent clogging of the nozzles.

Figure 4:
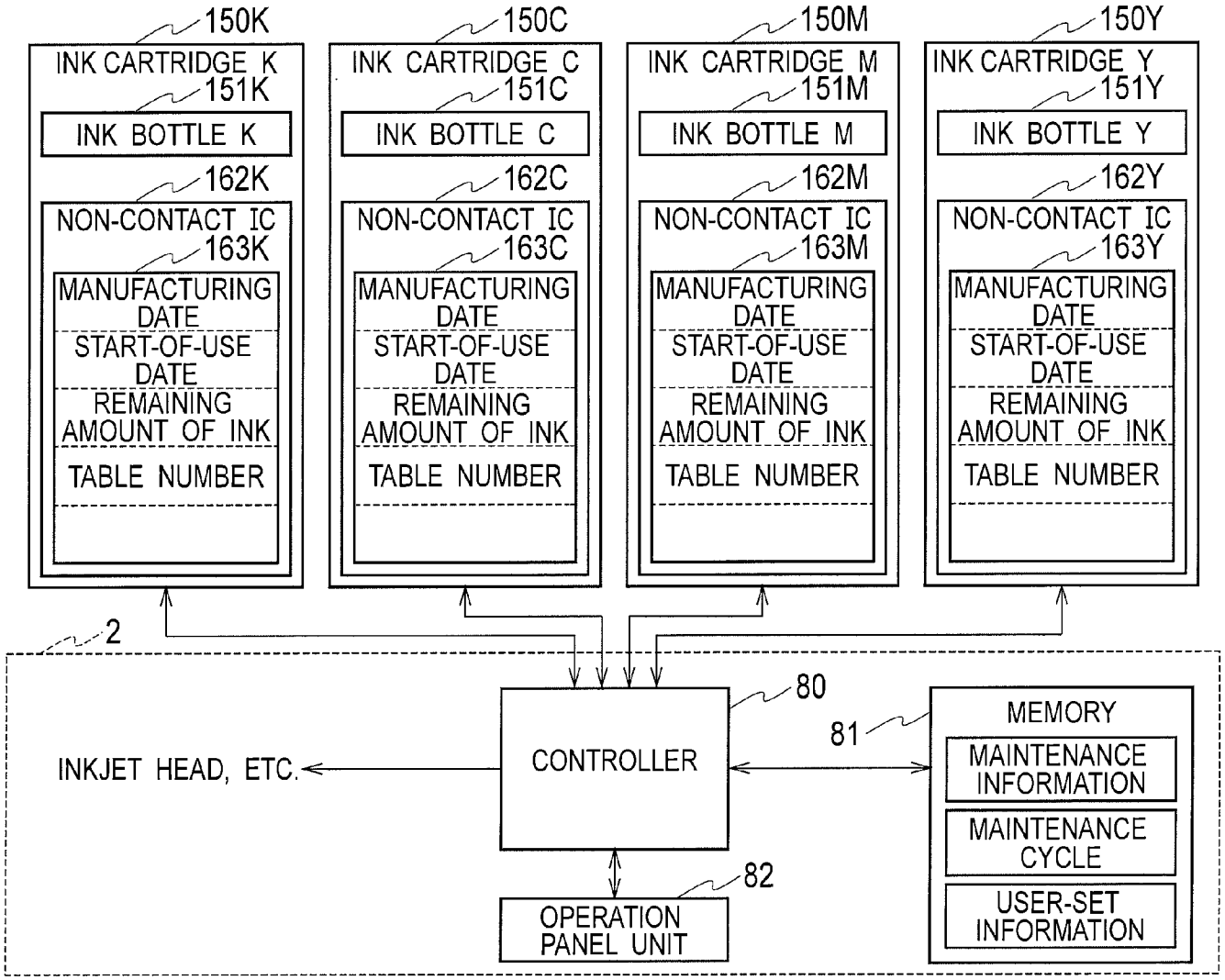
FIG. 4 is an explanatory diagram explaining a function of the inkjet printing machine according to Example 1 of the present invention.

FIG. 4 is an explanatory diagram explaining a function of the inkjet printing machine 1 according to Example 1 of the present invention.

As illustrated in FIG. 4, the inkjet printing machine 1 according to Example 1 of the present invention includes ink cartridges 150K, 150C, 150M and 150Y, and also a main device 5.

The main device 5 includes various devices such as a controller 80, a memory 81, a control panel 82, and inkjet heads.

The ink cartridge 150K corresponding to K (black) ink includes the ink bottle 151K and a non-contact integrated circuit 162K (tag), respectively. Note that, although description will be provided for the ink cartridge 150K corresponding to K (black) ink as a representative, the same also applies to other ink colors.

The non-contact integrated circuit 162K has a memory 163K, and performs wireless data communication with the controller 80 of the main device 5.

The memory 163K stores the manufacturing date of the ink cartridge 150K, the start-of-use date when the ink cartridge 150K is mounted on the main device 5, the remaining amount of ink held in the ink bottle 151K, and a table number indicating the type of ink held in the ink bottle 151K. Note that the remaining amount of ink can be calculated by subtracting the discharge amount or the like from the inkjet heads 110 from the initial amount, for example. The table number is one included in maintenance information described below, indicates a color such as C (cyan), M (magenta), Y (yellow) or K (black), or the type of solvent such as aqueous or oleaginous, and is identified in terms of numerical values such as "1" to "6".

Furthermore, the ink cartridges 150C, 150M and 150Y corresponding to C (cyan), M (magenta) and Y (yellow) ink similarly store the manufacturing date, the remaining amount of ink, and the table number, and perform wireless data communication with the controller 80 of the main device 5.

The memory 81 stores maintenance information, maintenance cycle, and user setting information of the inkjet printing machine 1.

FIG. 5 is a diagram illustrating exemplary maintenance information stored in the memory 81.

As illustrated in FIG. 5, table numbers, default values, lower limit values, and upper limit values are stored in the memory 81 in association with one another, as maintenance information. Here, for example, maker-recommended values are set as the default values. In addition, the number of sheets between a lower limit value and an upper limit value falls in a settable range in which setting of a maintenance cycle is possible.

When allowing the user to freely set a maintenance cycle which is smaller than the lower limit value, there may be a case where the user sets a shorter cycle than the lower limit value which is a maintenance cycle corresponding to the necessary and sufficient maintenance frequency. In such a case, an originally unnecessary maintenance may be performed, resulting in wasted ink consumption.

When allowing the user to freely set a maintenance cycle which is larger than the upper limit, there may be a case where the user sets a longer cycle than the upper limit value which is a maintenance cycle corresponding to the maintenance frequency required at least. Namely, there may be set a very long maintenance cycle so that maintenance operation is hardly performed, which may cause the dirt sticking to the ink discharge surface to accumulate on the inkjet head, and may also lead to exchange of inkjet heads due to nozzle clogging or the like.

Accordingly, the inkjet printing machine 1 according to Example 1 of the present invention defines a settable range in which setting of a maintenance cycle is possible through use setting by determining a lower limit value and an upper limit value, while allowing setting of a maintenance cycle in accordance with user's preference.

For example, the fact that ink of an ink type having a table number "4" has "2000" (sheets) set thereto as an default value means that setting of a maintenance cycle by user operation is possible as long as the value falls within a settable range of "100" (sheets) to "5000" (sheets).

In addition, the maintenance cycle stored in the memory 81 means the finally applied maintenance cycle, and the maintenance unit 4 performs a maintenance operation on the basis of the maintenance cycle stored in the memory 81.

The user setting information includes a flag indicating whether or not a user maintenance setting value has been set by user operation, and a user maintenance setting value which has been set by user operation.

Furthermore, a control panel 82 including an operation screen and a touch panel is connected to the controller 80. The control panel 82 is arranged on the upper part of the inkjet printing machine 1. The control panel 82 can be used as an input operation unit or the like, to which the user inputs a setting condition of a processing content such as the number of sheets to be printed when copy-printing a print image placed on a scanner unit (not illustrated), or executing a print job received from the outside.

The controller 80 has a function of performing data transfer by wireless communication with the ink cartridges mounted on the main device 5.

In addition, the controller 80 virtually constructs various types of functional modules by reading and executing a program as appropriate, and performs processing relating to image data, operation control of each unit, and various types of processing on user operation.

Specifically, when a use maintenance cycle having been stored in the memory 81 is set, the controller 80 reads, from the maintenance information stored in the memory 81, lower limit values and upper limit values (settable ranges) corresponding to table numbers stored in the memories 163 of all the ink cartridges, and when the user-set maintenance cycle is within the read-out settable ranges for all the ink types, the controller 80 causes the maintenance unit 4 to perform a maintenance operation with the user-set maintenance cycle being the maintenance cycle.

<Operation of Inkjet Printing Machine>

Next, the operation of the inkjet printing machine 1 according to Example 1 of the present invention will be described.

Figure 6:
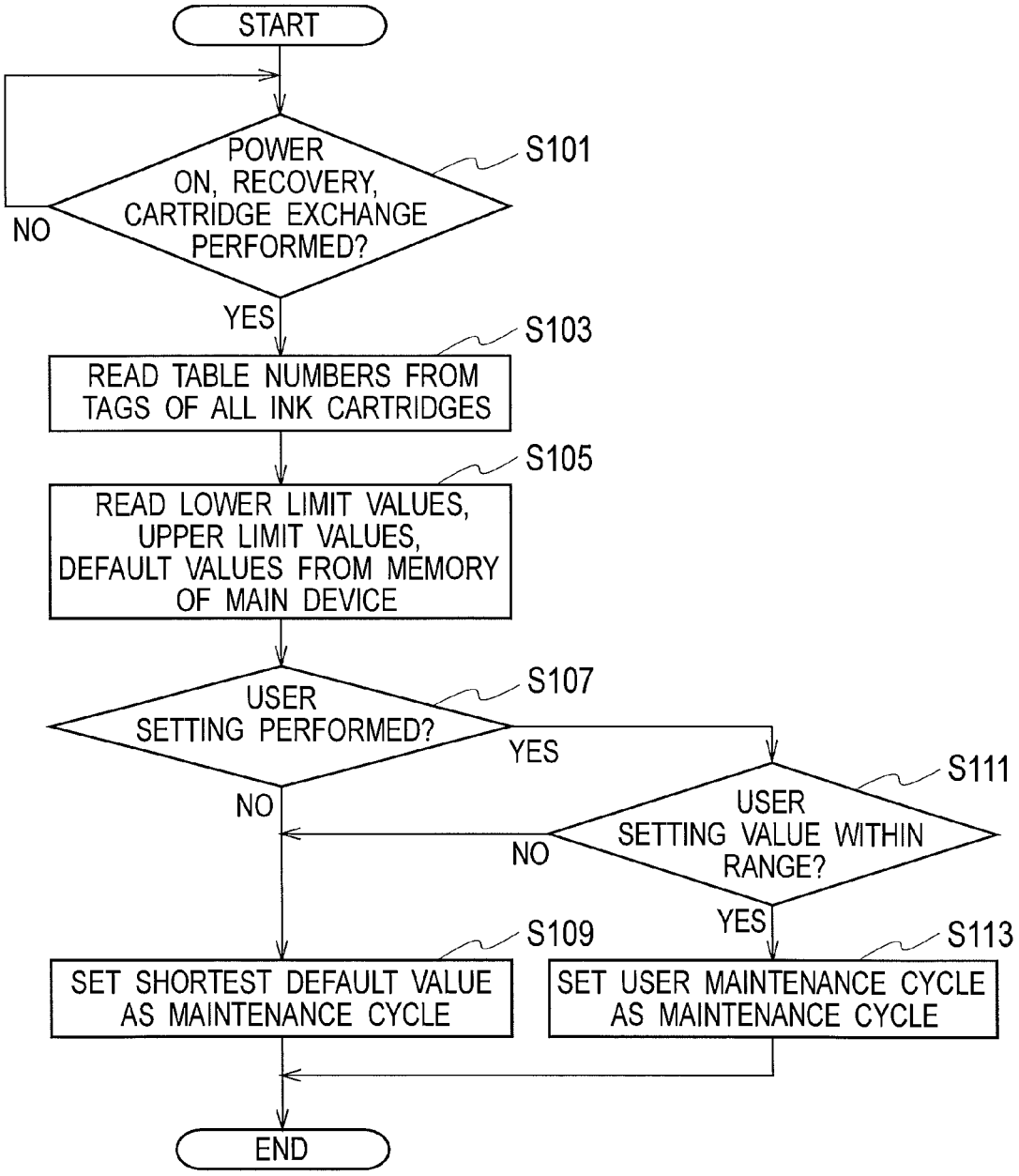
FIG. 6 is a flowchart illustrating a processing procedure in the inkjet printing machine according to Example 1 of the present invention.

FIG. 6 is a flowchart illustrating a processing procedure in the inkjet printing machine 1 according to Example 1 of the present invention.

As illustrated in FIG. 6, the inkjet printing machine 1 according to Example 1 of the present invention, when first detecting a press operation by the user of the power-on switch of the main device 5, detecting a recovery from a power saving mode or test mode, or detecting an ink cartridge exchange (YES at step S101), starts wireless communication with non-contact integrated circuits 162C, 162M, 162Y and 162K (tags) of all the ink cartridges 150C, 150M, 150Y and 150K, and obtains table numbers stored in the memories 163C, 163M, 163Y and 163K of the ink cartridges 150C, 150M, 150Y and 150K (step S103).

Next, the controller 80 reads, from the memory 81, a default value, a lower limit value, and an upper limit value corresponding to the obtained table numbers step S105).

Then, the controller 80 determines whether or not a user setting has been performed (step S107). Specifically, the controller 80 reads, from the user setting information stored in the memory 81, a flag indicating whether or not a user maintenance value has been set, and determines that a user setting has been performed when the flag is "ON".

When it is determined that a user setting has not been performed (NO at step S107), the controller 80 sets, at step S105, the shortest default value among the read-in default values respectively corresponding to all the ink cartridges 150C, 150M, 150Y and 150K, as the maintenance cycle (step S109). For example, it is assumed that the table number stored in the memory 163C of the ink cartridge 150C is "2", the table number stored in the memory 163M of the ink cartridge 150M is "3", the table number stored in the memory 163Y of the ink cartridge 150Y is "2", and the table number stored in the memory 163K of the ink cartridge 150K is "4". According to the maintenance information illustrated in FIG. 5, the default value corresponding to the table number "2" is "750" (sheets), the default value corresponding to the table number "3" is "1000" (sheets), and the default value corresponding to the table number "4" is "2000" (sheets), and thus the controller 80 causes the memory 81 to store the shortest default value of "750" (sheets), as the maintenance cycle.

On the other hand, when it is determined at step S107 that a user setting has been performed (YES at step S107), the controller 80 determines whether or not the set user maintenance cycle is within the settable range for all the ink cartridges 15 (step S111).

Figure 7:
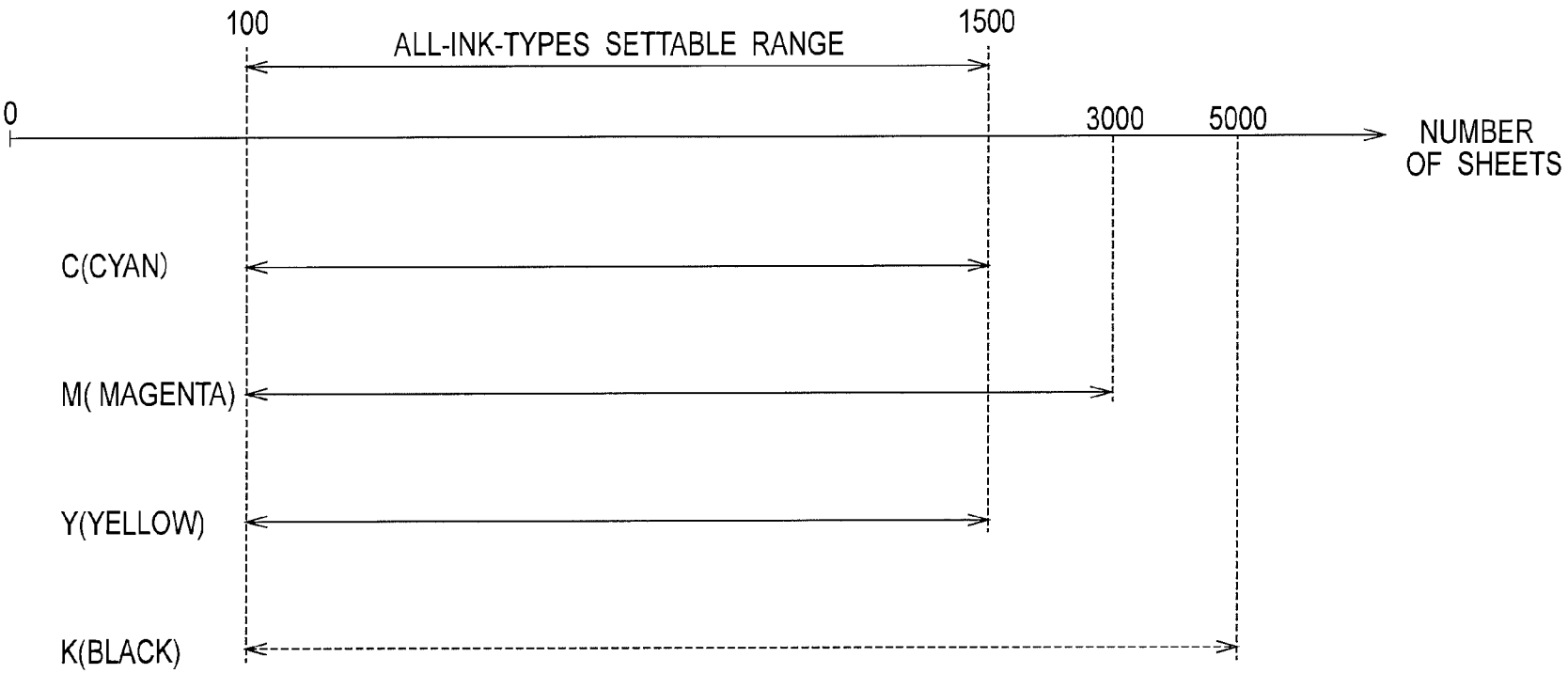
FIG. 7 is a diagram illustrating an exemplary settable range common to all the ink cartridges.

FIG. 7 is a diagram illustrating an exemplary settable range to all the ink cartridges 150.

As illustrated in FIG. 7, when it is assumed that the settable range of C (cyan) is set from 100 (sheets) to 1500 (sheets), the settable range of M (magenta) is set from 100 (sheets) to 3000 (sheets), the settable range of Y (yellow) is set from 100 (sheets) to 1500 (sheets), and the settable range of K (black) is set from 100 (sheets) to 5000 (sheets), the settable range to all the ink becomes 100 (sheets) to 1500 (sheets).

Accordingly, the controller 80 determines whether or not the set user maintenance cycle is within 100 (sheets) to 1500 (sheets).

When it is determined that the set user maintenance cycle is within the settable range to all the ink cartridges 150 (YES at Step S111), even when executing a maintenance operation on the basis of the set user maintenance cycle, there is no disadvantage of wasteful ink consumption, nozzle dogging or the like due to the maintenance operation, and thus the memory 81 is updated with the user maintenance cycle included in the user setting information being the maintenance cycle (step S113). Accordingly, the maintenance unit 4 thereafter performs maintenance operation on the basis of the updated maintenance cycle in the memory 81.

On the other hand, when it is determined the set user maintenance cycle is out of the settable range to all the ink cartridges 150 (NO at step S111), when executing a maintenance operation on the basis of the set user maintenance cycle, there may be generated a disadvantage of wasteful ink consumption, nozzle clogging or the like due to the maintenance operation.

Accordingly, the controller 80 proceeds to the processing at step S109 and sets the shortest default value among the read-in default values respectively corresponding to all the ink cartridges 150C, 150M, 150Y and 150K as the maintenance cycle without using the user-set maintenance cycle step S109).

As described above, according to the inkjet printing machine 1 according to Example 1 of the present invention, the controller 80 reads, from the maintenance information stored in the memory 81, lower limit values and upper limit values settable ranges) corresponding to table numbers stored in the memories 163 of all the ink cartridges and, when a user maintenance cycle having been stored in the memory 81 is set and the user-set maintenance cycle is within the read-out settable ranges for all the ink types, the controller 80 causes the maintenance unit 4 to perform a maintenance operation with the user-set maintenance cycle being the maintenance cycle.

Accordingly, a user-set maintenance cycle is set as the maintenance cycle within a range not causing wasted ink consumption and not generating a disadvantage due to nozzle clogging or the like, and thus it is possible to set a maintenance cycle in accordance with user's preference within an appropriate range.

In addition, according to the inkjet printing machine 1 according to Example 1 of the present invention, the shortest default value among the read-out default values is set as the maintenance cycle of the maintenance section without using the user-set user setting maintenance cycle when the user-set maintenance cycle is outside the read-out settable range of any of the ink types.

Accordingly, a default value (for example, a maker-recommend value) is set so as not to cause wasted ink consumption and not to generate a disadvantage due to nozzle clogging or the like, whereby it is possible to perform a maintenance operation with an appropriate frequency.

Furthermore, the ink cartridges 150 appearing in Example 1 of the present invention have memories that store the ink types to be discharged from the inkjet heads 110 so that, when a maintenance cycle is set by the user and the user-set maintenance cycle is within the read-out settable ranges for all the ink types, the main device 5 executes a maintenance operation on the basis of the user-set maintenance cycle, and thus the main device 5 can set a maintenance cycle in accordance with user's preference within an appropriate range.

Example 2 of Present Invention

In Example 1 of the present invention, the shortest default value among the read-in default values respectively corresponding to all the ink cartridges 150C, 150M, 150Y and 150K is set as the maintenance cycle, when the set user maintenance cycle is determined to be outside the settable ranges for all the ink cartridges 150 as indicated at step S111 of FIG. 6.

In Example 2 of the present invention, explanation is given taking, as an example, an inkjet printing machine that sets, as the maintenance cycle, the upper limit value or the lower limit value falling in a settable range to all the ink types, which is closer to the user-set maintenance cycle when the set user maintenance cycle is determined to be outside the settable ranges for all the ink cartridges 150.

Figure 8:
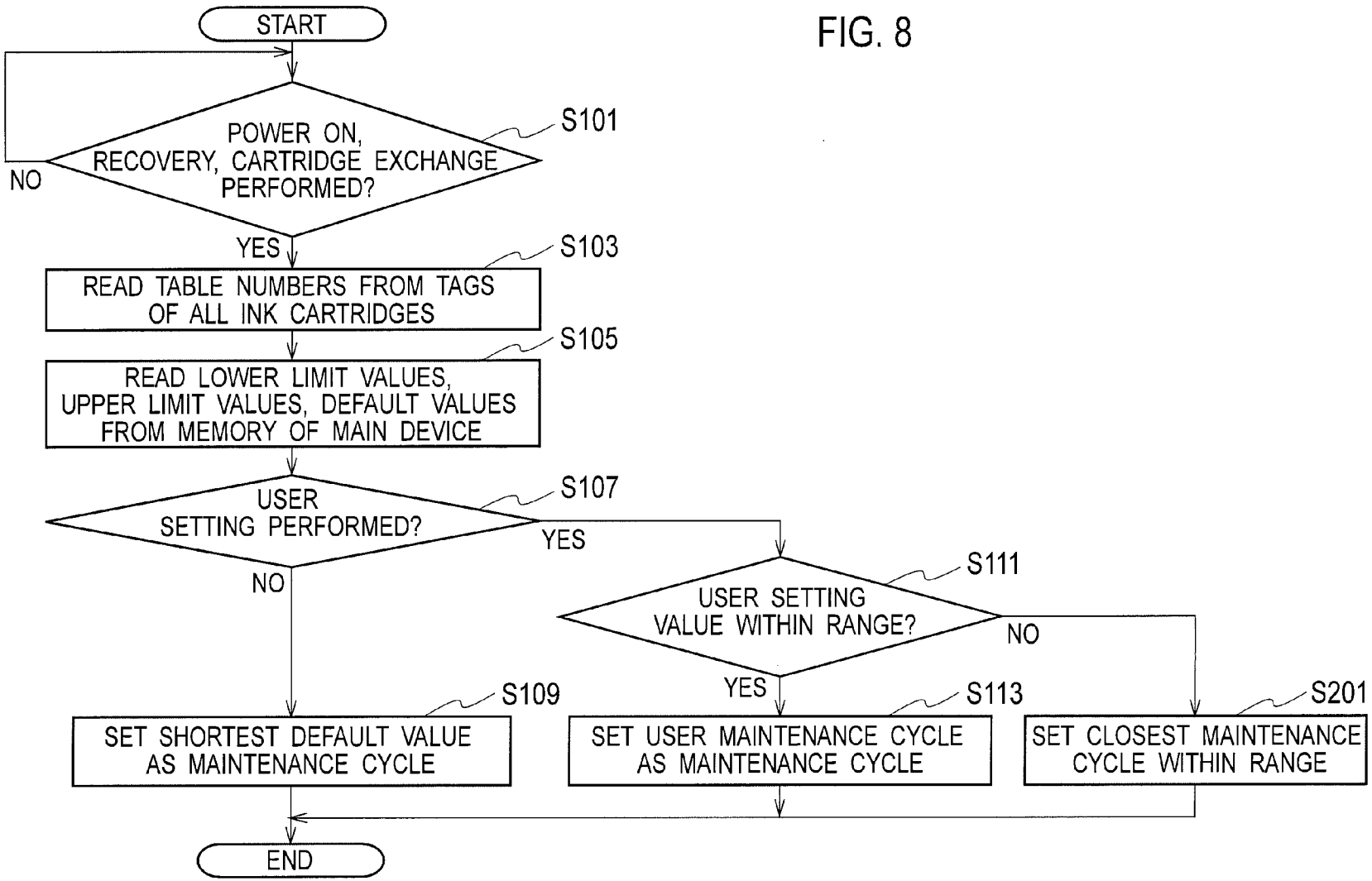
FIG. 8 is a flowchart illustrating a processing procedure in the inkjet printing machine 1 according to Example 2 of the present invention.

FIG. 8 is a flowchart illustrating a processing procedure in the inkjet printing machine 1 according to Example 2 of the present invention. Note that, since the processes of steps S101 to S113 are the same as those of Example 1, explanation thereof will be omitted and only step S201 will be described.

As illustrated in FIG. 8, when it is determined at step S111 that the set user maintenance cycle is outside the settable ranges for all the ink cartridges 150 (NO), there may be generated a disadvantage of wasteful ink consumption, nozzle clogging or the like due to the maintenance operation by performing a maintenance operation on the basis of the set user maintenance cycle.

Accordingly, the controller 80 sets, as the maintenance cycle, the upper limit value or the lower limit value falling in a settable range to all the ink types, which is closer to the user-set maintenance cycle (step S201).

For example, it is assumed that the user-set maintenance cycle is 2000 (sheets). At this time, as illustrated in FIG. 7, the settable range of C (cyan) is set from 100 (sheets) to 1500 (sheets), the settable range of M (magenta) s set from 100 (sheets) to 3000 (sheets), the settable range of Y (yellow) is set from 100 (sheets) to 1500 (sheets), and the settable range of K (black) is set from 100 (sheets) to 5000 (sheets), and thus the lower limit value for all the ink types is 100 (sheets), and the upper limit value is 1500 (sheets).

The value of 2000 (sheets) which has been set as the user-set maintenance cycle is closer to the upper limit value of 1500 (sheets) than the lower limit value of 100 (sheets), and thus the controller 80 sets the upper limit value of 1500 (sheets) as the maintenance cycle.

Accordingly, the maintenance cycle close to a user-set user maintenance cycle is set within a range not causing wasted ink consumption and not generating a disadvantage due to nozzle clogging or the like, and thus it is possible to set a maintenance cycle in accordance with user's preference within a more appropriate range.

The present invention is not limited to the plurality of embodiments of Examples described above as they are, but can be embodied at the stage of practice by modifications of constituent elements in a range not deviating from the gist thereof. In addition, a variety of inventions can be formed by appropriate combinations of the plurality of constituent elements disclosed in the aforementioned embodiments. For example, several constituent elements may be removed from all the constituent elements illustrated in the embodiments.

In addition, for example, each of the described functions and processes may be implemented by one or more processing circuits. The processing circuits include a programmed processor, an electric circuit or the like, and further include a device such as an Application Specific Integrated Circuit (ASIC), circuit components arranged so as to execute the described functions, or the like.

The present application claims priority on the basis of Japanese Patent Application No. 2015-162415 filed on Aug. 20, 2015, the entire content of which being incorporated herein by reference.

INDUSTRIAL APPLICABILITY

According to the present invention, a controller reads settable ranges of maintenance cycles corresponding to ink types stored in the memories of all the ink cartridges, compares a user-set maintenance cycle with the read-out settable ranges for all the ink types, and sets an appropriate maintenance cycle for the maintenance section, and thus a maintenance cycle in accordance with user's preference is set within a range not causing wasted ink consumption and not generating a disadvantage due to nozzle clogging or the like, even when the user sets the maintenance cycle.

REFERENCE SIGNS LIST

1 inkjet printing machine
2 transfer section
3 head unit
4 maintenance unit (maintenance section
5 main device
80 controller
81 memory (storage section)
82 control panel (user setting section)
110C, 110M, 110Y, 110K inkjet head
150C, 150M, 150Y, 150K ink cartridge
162C, 162M, 162Y, 162K non-contact integrated circuit
163C, 163M, 163Y, 163K memory

What is claimed is:

1. An inkjet printing machine having a main device that performs printing by discharging ink from a plurality of inkjet heads, and ink cartridges being detachably mounted on the main device and having memories that store ink types of ink held therein, the printing machine comprising:

a maintenance section configured to perform a maintenance operation simultaneously on the plurality of inkjet heads;

a storage section configured to store, for each of the ink types, a settable range of a maintenance cycle to be performed by the maintenance section, as maintenance information;

a user setting section configured to perform user setting of the maintenance cycle on the basis of a user operation; and a controller configured to read, from the maintenance information, settable ranges of the maintenance cycles corresponding to ink types stored in the memories of all the ink cartridges when user setting of the maintenance cycle has been performed by the user setting section, and to set the user-set maintenance cycle as the maintenance cycle of the maintenance section when the user-set maintenance cycle is within the read-out settable ranges for all the ink types to prevent wasted ink consumption.

2. The inkjet printing machine according to claim 1, wherein the storage section stores, for each of the ink types, the settable range of the maintenance cycle and a default value of the maintenance cycle in association with each other, as maintenance information, and the controller reads, from the maintenance information, settable ranges and default values of the maintenance cycles corresponding to ink types stored in the memories of all the ink cartridges when user setting of the maintenance cycle has been performed by the user setting section, and sets the shortest default value among the read-out default values as the maintenance cycle of the maintenance section when the user-set maintenance cycle is outside the read-out settable range of any of the ink types.

3. The inkjet printing machine according to claim 1, wherein the storage section stores, for each of the ink types, the settable range of the maintenance cycle and a default value of the maintenance cycle in association with each other, as maintenance information, and the controller reads, from the maintenance information, settable ranges and default values of the maintenance cycles corresponding to ink types stored in the memories of all the ink cartridges when user setting of the maintenance cycle has been performed by the user setting section, and sets, as the maintenance cycle of the maintenance section, an upper limit value or a lower limit value falling in a settable range to all the ink types, which is closer to the user-set maintenance cycle when the user-set maintenance cycle is outside the read-out settable range of any of the ink types.

4. An ink cartridge detachably mounted to a main device of an inkjet printing machine, the inkjet printing machine including:

the main device configured to perform printing by discharging ink from a plurality of inkjet heads;

a maintenance section configured to perform a maintenance operation simultaneously on the plurality of inkjet heads;

a storage section configured to store, for each of ink types, a settable range of a maintenance cycle to be performed by the maintenance section, as maintenance information;

a user setting section configured to perform user setting of the maintenance cycle on the basis of a user operation; and a controller configured to read, from the maintenance information, settable ranges of the maintenance cycles corresponding to ink types stored in memories of all the ink cartridges when user setting of the maintenance cycle has been performed by the user setting section, and to set the user-set maintenance cycle as the maintenance cycle of the maintenance section when the user-set maintenance cycle is within the read-out settable ranges for all the ink types to prevent wasted ink consumption, wherein the ink cartridge has the memories that store the ink types of ink discharged from the plurality of inkjet heads, the memories enable the main device to perform the maintenance operation on the basis of the user-set maintenance cycle when the user setting of the maintenance cycle has been performed and the user-set maintenance cycle is within the read-out settable ranges for all the ink types.

* * * * *